US005730324A

United States Patent [19]

Shannon et al.

[11] Patent Number: 5,730,324

[45] Date of Patent: Mar. 24, 1998

[54] SYRUP DISPENSING METHOD AND SYSTEM FOR A BEVERAGE DISPENSER

[75] Inventors: Joseph W. Shannon, Kent; Ming Zhang, Akron, both of Ohio

[73] Assignee: IMI Wilshire Inc., Anoka, Minn.

[21] Appl. No.: 644,425

[22] Filed: May 10, 1996

[51] Int. Cl.[6] ..... B67D 5/08

[52] U.S. Cl. ..... 222/61; 222/64; 222/129.1

[58] Field of Search ..... 222/55, 61, 64, 222/129.1, 136, 399

[56] References Cited

U.S. PATENT DOCUMENTS

| | | | |
|---|---|---|---|
| 556,002 | 9/1996 | Green | 222/61 |
| 4,006,840 | 2/1977 | Shannon | 222/30 |
| 4,252,253 | 2/1981 | Shannon | 222/25 |
| 4,560,089 | 12/1985 | McMillin et al. | 222/61 |
| 4,903,862 | 2/1990 | Shannon et al. | 222/54 |
| 4,938,396 | 7/1990 | Shannon | 222/641 |
| 5,000,357 | 3/1991 | Shannon et al. | 222/129.1 |
| 5,012,955 | 7/1991 | Shannon | 222/61 |
| 5,033,645 | 7/1991 | Shannon et al. | 222/61 |
| 5,058,782 | 10/1991 | Shannon | 222/330 |
| 5,072,853 | 12/1991 | Shannon | 222/1 |
| 5,145,092 | 9/1992 | Shannon | 222/61 |

*Primary Examiner*—Philippe Derakshani
*Attorney, Agent, or Firm*—Vickers, Daniels & Young

[57] ABSTRACT

A post-mix beverage dispensing system for delivering syrup from a supply reservoir to one or more dispensing stations and to one or more drink dispensing units at each station including a syrup dispensing valve for the syrup in the reservoir. The syrup is adapted to be delivered from the reservoir at the delivery pressure generated by the reservoir pump and which, in light of a pressure drop between the reservoir and dispensing station or stations, may or may not provide a predetermined syrup dispensing pressure required at the dispensing station for dispensing a predetermined quantity of syrup through the dispensing valve to provide the desired syrup to soda water ratio in a dispensed drink.

67 Claims, 3 Drawing Sheets

SYRUP DISPENSING METHOD AND SYSTEM FOR A BEVERAGE DISPENSER

BACKGROUND OF THE INVENTION

This invention relates to the art of soft drink dispensing and, more particularly, to methods and systems for delivering flavored syrup to soft drink dispensing valves.

Carbonated beverages are sold in restaurants, snack shops, amusement parks, fast food outlets, and other establishments throughout the world. Post-mixed beverage dispensers are used in many of these establishments in that they are convenient in enabling an establishment to purchase concentrated beverage flavoring syrup which takes up significantly less space and is easier to handle than canned or bottled beverages. In a post-mixed beverage dispenser, syrup from a supply container is delivered under pressure through a plastic delivery tube to a beverage dispensing station where it is combined with soda water, mixed and dispensed into a container, such as a glass or paper cup. In many establishments, several different beverages are offered at one or more dispensing stations which have several different dispensing valves, each for a different beverage, such as diet and non-diet colas and/or different brand colas. All of the elements of a post-mix beverage dispensing system taken together are too bulky to be used in the front or customer service area of many establishments, particularly franchise fast food establishments, where counter space in the customer service area is at a premium. Therefore, portions of the beverage dispensing system not absolutely required in the service area, such as carbonators, syrup supply reservoirs, and the like, are remotely located in a non-service area, such as a rear area of the establishment. Such rear areas can be a considerable distance from the beverage dispensing station in the service area of the establishment, and this distance can be well over 100 feet.

Preparation of consistently high quality dispensed beverages in a post-mix system requires that syrup and soda water be mixed in a precise ratio and dispensed into a container without loss of the ratio or carbonation. Moreover, the desired ratio and carbonation must be attainable under widely varying dispensing conditions and, in particular, must be attainable when multiple dispensing valves are operated simultaneously, and in high demand times when such multiple dispensing valves are being operated repeatedly at a high rate as well as simultaneously. One of the most difficult problems to address in connection with attaining a desired syrup to soda water ratio with currently available dispensing systems is the pressure drop in the syrup tube between the supply reservoir and the dispensing station during a dispensing operation. In this respect, syrup is delivered from a reservoir to the plastic delivery tube at a delivery pressure generated by the reservoir pump and which pressure at the dispensing station, in most instances, is higher than the dispensing pressure required at the dispensing station for dispensing a single drink having the desired amount of syrup. Independent of the pressure drop resulting from multiple simultaneous dispensing, the initial delivery pressure drops during delivery of the syrup from the reservoir to the dispensing station as the result of a number of different and varying factors. In particular, the pressure drop results from the expandable and contractible nature of the plastic delivery tube, the distance that the syrup has to be pumped from the reservoir to the dispensing station, by changes in elevation of the delivery tube between the reservoir and dispensing station, and by temperature and viscosity characteristics of the syrup. Thus, it will be appreciated that it is extremely difficult, if not impossible, to consistently maintain a constant desired syrup dispensing pressure at the syrup dispensing valve at the dispensing station. The result is variation of the syrup flow rate through the dispensing valve and, thus, the quantity of syrup in a dispensed drink and the ratio of syrup to soda water in the dispensed drink.

While the dispensing pressure, which is lower than the initial delivery pressure as a result of the pressure drop, may enable obtaining a desired syrup to soda water ratio in connection with the dispensing of a single drink, the further pressure drop resulting from multiple simultaneous dispensing and/or rapid sequential dispensing of the same drink from one or more dispensing stations served by the syrup reservoir will result in less than the desired amount of syrup in the drinks. With further regard to the latter, each drink dispenser at the dispensing station or stations includes a solenoid operated syrup dispensing valve having an adjustable, pressure responsive, flow control valve for supplying a pre-selected quantity of syrup in a dispensed drink. Such flow control valves have a relatively narrow pressure window with respect to delivering the pre-selected quantity of syrup thereacross. A pressure drop which results in a syrup pressure at the dispensing valve below the window level results in syrup starvation with respect to drinks dispensed and, thus an unacceptable drink. As mentioned above, distance, delivery tube expansion and contraction, and syrup temperature and viscosity characteristics affect pressure drop making it difficult to maintain the syrup dispensing pressure within the window even during periods of low demand dispensing operation of the system. This problem is compounded when multiple simultaneous dispensing and/or rapid sequential dispensing of drinks takes place. In this respect, the syrup is supplied from the reservoir at a specified delivery pressure and on a demand basis, and the simultaneous opening of two or more dispensing valves or the rapid sequential opening of one valve for syrup supplied from a common reservoir results in a demand on the syrup delivery pressure source which the latter cannot meet, thus causing a pressure drop resulting in syrup starvation. Furthermore, if one of the dispensing stations is further from the reservoir than the other, the fartherest station experiences a greater pressure drop and, thus, an increased syrup starvation relative to the other. Simultaneous dispensing as used herein means the opening of two or more dispensing valves at the same time, or the opening of a second or more valves while a first valve is open.

In an effort to overcome certain of the foregoing problems, it has been proposed heretofore, as shown in U.S. Pat. No. 4,903,862 for example, to deliver syrup from a source to a plurality of pump chambers between the source and syrup dispensing valves and from which the syrup is delivered to a corresponding dispensing valve at a temperature-compensated pumping pressure. In the latter patent, the temperature of the syrup in each chamber is monitored by a microprocessor, and when the corresponding drink dispensing valve is activated, $CO_2$ under a pressure determined from a table in the microprocessor is introduced into all of the chambers and the chamber outlet valve for the actuated drink dispensing valve opens for syrup to be delivered to the latter. At the end of the dispensing operation, all of the pump chambers are vented to atmosphere to evacuate the $CO_2$ therefrom. With the system in this patent, only one dispensing valve can be operated at any given time, thus increasing the overall time required to dispense a given number of drinks. This is of considerable disadvantage during high demand periods in an establishment. Moreover, if the microprocessor fails, the entire system becomes inoperable.

Another problem attendant to post-mix beverage dispensing systems relates to the syrup reservoir and the inability to track syrup consumption for such purposes as anticipating an empty condition in the reservoir. If the reservoir is a canister system in which syrup is kept under $CO_2$ pressure while stored in the canister, depletion of the syrup in the canister results in slugs of gas being introduced into the syrup delivery tube, whereby the drink dispensing valve then delivers the syrup and thus the drink in spurts. As a result, the desired syrup to soda water ratio is not achieved and spurting of the dispensed ingredients is often messy, both of which results are undesirable. While the problem of introducing slugs of gas into the syrup delivery tube is avoided with a bag-in-box supply reservoir wherein the syrup is in a collapsible bag and is dispensed therefrom by $CO_2$ under pressure applied to the exterior of the bag, or by a pump which sucks the syrup from the bag and discharges the syrup into the delivery line at a high pressure, it is not possible with a bag-in-box or with the canister system to visually determine the quantity of syrup remaining in the reservoir at any particular time. Accordingly, the reservoir often becomes empty prior to personnel anticipating the empty condition, thus promoting the possibility of $CO_2$ in the syrup delivery tube in a canister system and syrup starvation at the dispensing valve and, in either event, requiring a shut-down of the dispensing valve or valves associated with the reservoir until a new supply can be connected to the delivery tube. This problem is undesirable under almost all circumstances but especially if shutdown has to take place during a normally high demand period for dispensing drinks.

SUMMARY OF THE INVENTION

In accordance with the present invention, the foregoing and other problems attendant to syrup delivery in post-mix beverage dispensing systems heretofore provided are advantageously minimized or overcome. More particularly in this respect, a post-mix beverage dispensing system in accordance with the present invention provides for more consistently dispensing drinks having a desired syrup content and thus syrup to soda water ratio under varying conditions including varying syrup characteristics, high and simultaneous dispensing demands, and pressure drops resulting from the latter and from other factors including the distance between the syrup supply reservoir and the drink dispensing station or stations.

In accordance with the present invention, syrup is delivered from a supply reservoir to one or more dispensing stations and to one or more drink dispensing units at each station including a syrup dispensing valve for the syrup in the reservoir. The syrup is adapted to be delivered from the reservoir at the delivery pressure generated by the reservoir pump and which, in fight of a pressure drop between the reservoir and dispensing station or stations, may or may not provide a pre-determined syrup dispensing pressure required at the dispensing station for dispensing a pre-determined quantity of syrup though the dispensing valve to provide the desired syrup to soda water ratio in a dispensed drink. In accordance with one aspect of the invention, a syrup chamber is provided near the dispensing station and has a bottom opening in flow communication with the syrup delivery tube between the reservoir and dispensing station through a syrup flow control valve arrangement which, preferably provides for the chamber to be filled with syrup from the reservoir and provides for syrup to be delivered from the chamber to the dispensing station on a when needed basis. More particularly, syrup is delivered from the chamber in response to a dispensing operation or operations which result in the syrup dispensing pressure as provided by the reservoir delivery pressure being below the pre-determined syrup dispensing pressure. More particularly in this respect, the syrup chamber is connected to a source of $CO_2$ under pressure which is adequate under all anticipated conditions to pressurize syrup in the chamber to a constant, pre-determined pressure for delivering syrup therefrom to the dispensing station to provide the pre-determined syrup dispensing pressure. If the delivery pressure from the reservoir is adequate to provide the dispensing pressure at the dispensing station, no syrup is delivered thereto from the syrup chamber. If, however, the delivery pressure is not adequate, or becomes inadequate during a dispensing operation, syrup is delivered to the dispensing station from the syrup chamber and, during such delivery, the syrup in the chamber is constantly pressurized to the pre-determined pressure, thus to maintain the pre-determined dispensing pressure at the dispensing station and thus the dispensing of the pre-determined amount of syrup to obtain the desired syrup to soda water ratio in the dispensed drink or drinks.

The syrup delivery pressure from the reservoir may be inadequate at all times if, for example, the distance between the reservoir and dispensing station or stations alone or together with other factors affecting a pressure drop result in the pressure at the syrup dispensing valve being below the pre-determined dispensing pressure. In the latter situation, the syrup chamber would be operable in conjunction with each dispensing operation to assure delivery of syrup to the dispensing station at the predetermined dispensing pressure. On the other hand, the pressure drop from the delivery pressure to the pressure at the dispensing valve may result in the latter being sufficient for providing the necessary dispensing pressure for dispensing a single drink, whereby there is no delivery of syrup from the syrup chamber to the dispensing station in response to a first drink dispensing operation. However, should a second drink dispensing operation be initiated at the same time as the first, or during the duration of the latter, the resulting pressure drop may result in the syrup dispensing pressure being below the required pressure, whereupon syrup is delivered from the chamber to the dispensing station to provide the pre-determined dispensing pressure at each syrup dispensing valve. Following a dispensing operation in which the delivery of syrup from the syrup chamber to the dispensing station takes place, the chamber is refilled by syrup from the supply reservoir and the chamber is momentarily vented to atmosphere to preclude carbonation of the syrup by the $CO_2$ under pressure and to preclude exposure of the syrup to oxygen which would result from maintaining the exhaust system open.

In accordance with another aspect of the invention, the syrup dispensing system is adapted to be operated independent of any electrical or other control associated with the dispensing unit or units at the dispensing station. In this respect, the system is activated in response to the flow of syrup resulting from the opening of a dispensing valve and is deactivated or prepared for deactivation when flow ceases. The supplemental syrup supply system includes a controller responsive to syrup flow in the delivery tube to cause pressurization of the syrup in the chamber and, when necessary, to open the syrup flow control valve arrangement between the chamber and delivery tube for the delivery of syrup from the chamber to the dispensing station. When flow ceases, the controller is operable to maintain the syrup flow control valve arrangement open for the chamber to refill with syrup from the supply reservoir and, thereafter, the controller is operable to close the syrup flow control valve arrangement and to cause opening of an exhaust valve to exhaust $CO_2$ from the chamber. Preferably, flow is sensed by a flow sensor or flow meter disposed in the syrup delivery tube, and the bottom end of the chamber and the syrup flow control valve arrangement are connected to the delivery tube by a T-coupling. This advantageously enables the supplemental syrup supply system and the associated control components to be readily added to an existing post-mixed beverage dispenser wherein the syrup supply reservoir, syrup delivery tube, a source of $CO_2$ under pressure and a dispensing station or stations are already in place.

Further in accordance with the present invention, a plurality of syrup chambers, each having its own controller, can be connected to a common source of $CO_2$ under pressure, such as by a manifold arrangement, for all of the chambers to be pressurized simultaneously in response to any one of the controllers being activated by flow in the corresponding delivery tube. In this case the exhausting of the chambers to atmosphere following completion of the dispensing operation, or following the completion of multiple simultaneous dispensing operations, is controlled by the controller of the last syrup chamber system from which there is flow to the dispensing station therefrom.

Further in accordance with the present invention, the supplemental syrup supply system advantageously provides for fail-safe operation of the drink dispensing system of which it is a part. In this respect, should the controller fail, the dispensing stations remain in flow communication with the corresponding syrup supply reservoir, whereby the dispensing of drinks can continue. The controller can output a warning signal notifying personnel of the breakdown, whereby, in most instances drink dispensing can continue at least on a single drink basis to assure the dispensing of drinks having the desired syrup to soda water ratio until such time as the controller is again functional to put the supplemental syrup supply system back in operation.

In accordance with yet another aspect of the invention, the flow meter can monitor the quantity of syrup supplied from the reservoir to the dispensing station or stations each time dispensing takes place and can provide this information to the controller microprocessor, whereby the microprocessor can track the consumption of syrup and output a signal to an indicator light or the like at the dispensing station or other suitable location to advise personnel that the syrup supply reservoir is approaching an empty condition. Further in accordance with this aspect of the invention, the microprocessor can store information regarding the quantity of syrup in stock at the establishment and can be connected to a telephone system through a modem, thus enabling remote monitoring of syrup supply condition in the establishment. In this respect, for example, the microprocessor can initiate a telephone call to a syrup supplier regarding the status of the supply of syrup either on a regular basis or when the supply reaches a low level. As another example, the outside supplier can call in and, through a digital signaling device, inquire regarding the status of the supply of different syrups, the amount of different syrups dispensed over a given interval of time, and the like. This advantageously avoids personnel in the establishment having to periodically make a visual count of the supply status and telephone a distributor to make a delivery of syrup. It also avoids the situation where personnel at the establishment forget to check the status and/or forget to call a distributor which could lead to the supply of a syrup or syrups being exhausted and creating a period of non-availability with respect to a particular drink or drinks. A further advantage resides in minimizing the quantity of syrup or syrups to be maintained in inventory in a given establishment, thus minimizing storage space required for the same.

It is accordingly an outstanding object of the present invention to provide improvements in connection with the delivery of syrup in a post-mix beverage system so as to more consistently obtain a desired syrup to soda water ratio with respect to drinks dispensed therefrom.

Another object is the provision of a system of the foregoing character wherein the necessary quantity of syrup for obtaining a desired syrup to soda water ratio can be consistently delivered to a dispensing station or stations during high demand periods of operation of the system and during the simultaneous dispensing of a plurality of drinks at a dispensing station or stations.

Still another object is the provision of a system of the foregoing character which provides for consistently dispensing syrup at a dispensing station at a constant predetermined syrup dispensing pressure regardless of varying pressure drops in the delivery tube between the supply reservoir and dispensing valve.

Still another object is the provision of a system of the foregoing character wherein a syrup chamber is provided between the supply reservoir and dispensing station or stations for delivering syrup to a dispensing station only when the syrup delivery line pressure between the syrup reservoir and the dispensing station is below a predetermined syrup dispensing pressure.

Yet another object is the provision of a system of the foregoing character wherein a controller is provided for controlling the delivery of syrup from the syrup chamber to a dispensing station or stations and wherein the system is operable to deliver syrup from the supply reservoir to the dispensing station in the event of controller failure.

A further object is the provision of a system of the foregoing character wherein the syrup chamber has a bottom opening in flow communication with the syrup delivery line from the syrup reservoir to the dispensing station or stations across a syrup flow control valve arrangement controlled by the controller to provide for the delivery of syrup from the chamber to the dispensing station on a when-needed basis and to provide for refilling the chamber from the supply reservoir during or following a dispensing operation.

Still another object is the provision of a system of the foregoing character wherein control of the delivery of syrup from the chamber to the dispensing station and from the supply reservoir to the chamber is adapted to be independent of any control components at the dispensing station.

A further object is the provision of a system of the foregoing character which can be readily added to an existing post-mix beverage dispensing system in which a syrup supply reservoir, syrup delivery tube and drink dispensing station are in place in an establishment.

Yet another object is the provision of a system of the foregoing character having improved capability with respect to tracking syrup consumption and enabling access to and/or programmed output of data regarding the status of syrup consumption for inventory maintenance purposes and the like.

BRIEF DESCRIPTION OF THE DRAWINGS

The foregoing objects, and others, will in part be obvious and in part pointed out more fully hereinafter in conjunction with the written description of preferred embodiments of the invention illustrated in the accompanying drawings in which.

DESCRIPTION OF PREFERRED EMBODIMENTS

Figure 1:
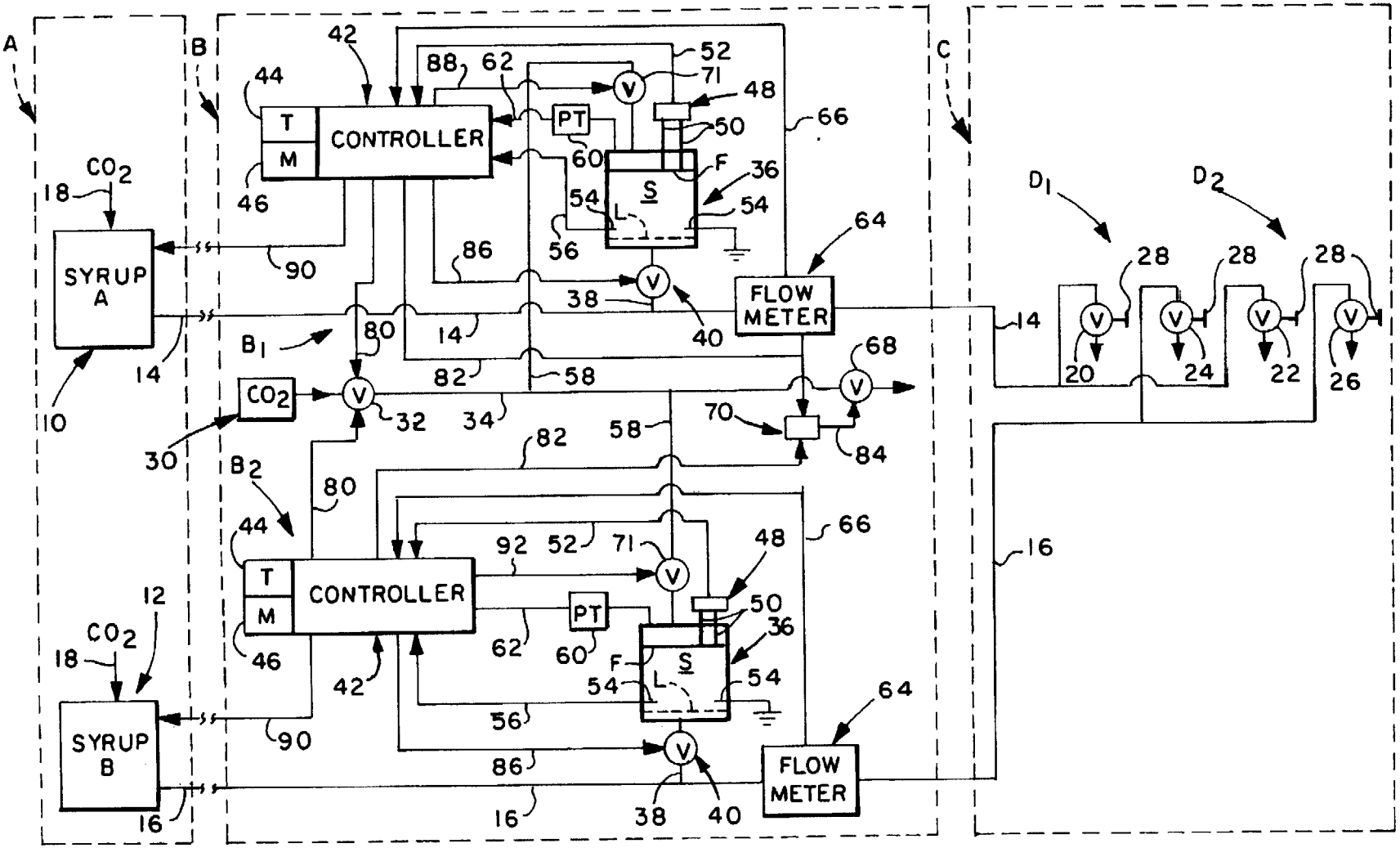
FIG. 1 is a schematic block diagram of syrup delivery systems in a post-mix beverage dispensing system and each of which syrup delivery systems includes a supplemental syrup supply system in accordance with the present invention.

Referring now in greater detail to the drawings wherein the showings are for the purpose of illustrating preferred embodiments of the invention only and not for the purpose of limiting the invention, FIG. 1 illustrates the syrup delivery portions of a post-mix beverage dispensing system in accordance with the invention and which include a syrup supply portion A, a supplemental syrup supply portion B and a dispensing portion C. In the embodiment illustrated, supply portion A includes syrup supply reservoirs 10 and 12 respectively for syrups A and B which, for example, may be different brands of syrup or different syrups of the same brand such as regular and diet cola syrups. Supply reservoirs 10 and 12 may be of the canister type or of the bag-in-box type and, in the embodiment illustrated, syrup under pressure is delivered from reservoirs 10 and 12 to syrup delivery lines 14 and 16, respectively by $CO_2$ under pressure as indicated by arrows 18. Syrup delivery line 14 extends from supply reservoir 10 to dispensing portion C of the system and, in the embodiment illustrated, to corresponding solenoid-operated syrup dispensing valves 20 and 22 at dispensing stations D1 and D2, respectively. Similarly, syrup delivery line 16 extends from syrup supply reservoir 12 to dispensing portion C and to corresponding solenoid-operated syrup dispensing valves 24 and 26 at dispensing stations D1 and D2, respectively. As is well known, and thus not illustrated in detail in FIG. 1, each of the syrup-dispensing valves 20, 22, 24, and 26 is located in a dispensing head or nozzle at the corresponding dispensing station with a corresponding mechanical or solenoid actuated soda water dispensing valve. Upon depression of a common actuator switch button or the like, as designated by the numeral 28, the syrup and soda water valves are activated to the open positions thereof for dispensing predetermined quantities of syrup and soda water thereacross in accordance with the settings of the corresponding pressure actuated flow control valves and the pressure in the corresponding one of the syrup and soda water lines.

In the embodiment illustrated in FIG. 1, supplemental syrup supply portion B includes supplemental syrup supply systems B1 and B2 respectively associated with syrup delivery line 14 from supply reservoir 10 and syrup supply line 16 from supply reservoir 12. Further in connection with this embodiment, systems B1 and B2 are associated with a common source 30 of $CO_2$ under pressure through a normally closed solenoid operated $CO_2$ flow control valve 32 and a $CO_2$ line or manifold 34. Each of the supplemental syrup supply systems B1 and B2 includes a syrup chamber 36 having a bottom opening connected in flow communication with the corresponding one of the syrup delivery lines 14 and 16 by a flow line 38 extending between the bottom opening and the syrup delivery line. A solenoid operated syrup flow control valve arrangement 40 is interposed in line 38 between chamber 36 and the corresponding syrup delivery line and, as described in greater detail hereinafter, is operable to control the delivery of syrup to chamber 36 from the corresponding syrup reservoir and to control the delivery of syrup from chamber 36 to the corresponding syrup dispensing valves at dispensing stations D1 and D2. Each of the systems B1 and B2 further includes a controller 42 which includes a microprocessor having timer and memory circuitry as indicated by the numerals 44 and 46, respectively. Each syrup chamber 36 is provided with a top syrup level detector 48 comprising probes 50 extending into the chamber from the upper end thereof and having lower ends which are spaced apart and bridged by syrup in the chamber to provide electrical continuity therebetween when the level of syrup S is at the level F or filled level as determined by the lower ends of the probes. Level detector 48 is operable to output control signals through a line 52 to controller 42, one of which signals indicates that the syrup in the chamber is at the filled level as determined by the lower ends of probes 50 and the other of which indicates that the syrup level has dropped below the lower ends of the probes and thus below level F. Each chamber further includes a low level indicator comprising probes 54 for sending a low-level signal to controller 42 through line 56 when the level of syrup S is at a level L below that of probes 54.

Figure 2:
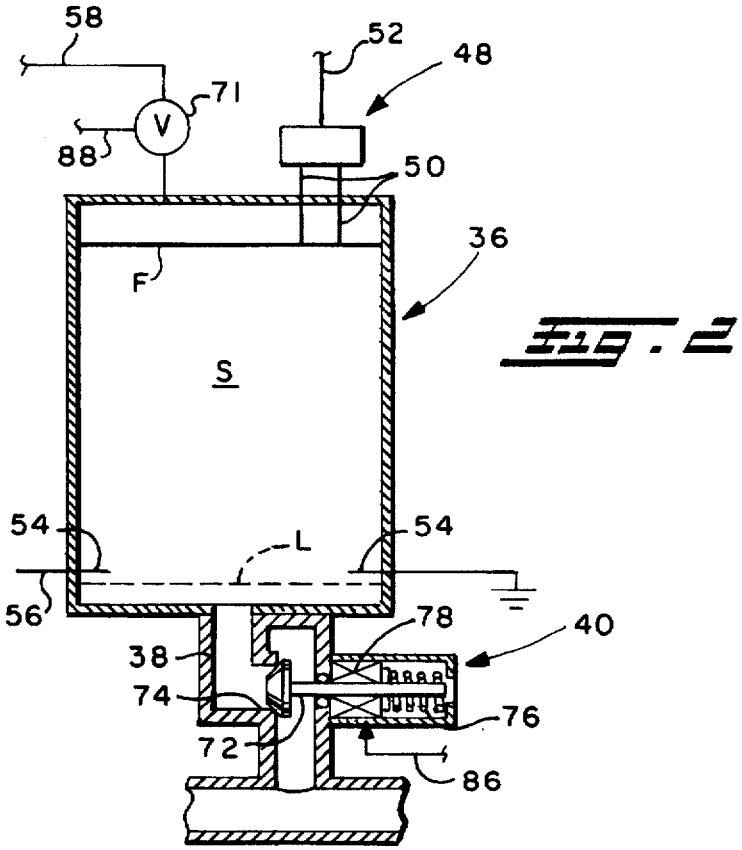
FIG. 2 is a schematic illustration of one embodiment of a syrup flow control valve arrangement for use with the system illustrated in FIG. 1.

The top end of each syrup chamber 36 is connected in flow communication with $CO_2$ manifold line 34 by a branch flow line 58 therebetween, and each chamber is provided with a pressure transducer 60 which is operable to output a control signal to controller 42 which is indicative of the pressure in chamber 36. As will become apparent hereinafter, in a multiple supplemental syrup supply system as shown in FIG. 1 in which the individual systems are associated with a common source of $CO_2$ under pressure, the function of pressure transducers 60 can be provided by a single pressure transducer in manifold line 34. As described in greater detail hereinafter, when systems B1 and B2 are in operation, controllers 42 are operable to control $CO_2$ flow control valve 32 to constantly maintain a predetermined pressure in chambers 36 to provide the necessary dispensing pressure for the syrup at each of the syrup dispensing valves. Each of the systems B1 and B2 further includes a flow meter 64 in the corresponding one of the syrup delivery lines 14 and 16 for outputting control signals through line 66 to the corresponding controller 42 for the purposes set forth hereinafter. $CO_2$ manifold line 34 includes a normally closed exhaust valve 68 which, in the embodiment illustrated, is adapted to be momentarily opened by an exhaust valve control component 70 in the manner set forth hereinafter. For the purpose set forth hereinafter, each of the $CO_2$ branch lines 58 from manifold 34 to syrup chambers 36 can be provided with a corresponding normally open solenoid operated shutoff valve 71. One embodiment of syrup flow control valve arrangement 40 for use in the supplemental syrup supply systems B1 and B2 as thus far described is illustrated in FIG. 2 of the drawing in connection with delivery line 14. In this arrangement, the solenoid operated valve includes a valve element 72 biased to its normally closed position against a valve seat 74 by a biasing spring 76. The valve is adapted to be opened by activating solenoid coil 78 and is closed by spring 76 when coil 78 is deactivated. For the purpose which will become apparent hereinafter, spring 76 biases valve element 72 in the direction opposite the direction of flow of syrup S thereacross from chamber 36 to line 14 when the valve is open and the bias is just sufficient to keep the valve closed.

Generally, syrup portion A of the system is located in a remote area of an establishment relative to dispensing portion C and may, for example, be from 20 to 100 feet from the latter. Accordingly, there will be a pressure drop in the delivery of syrups A and B from supply portion A to dispensing portion C from the supply pressure generated at the corresponding syrup reservoir, and, independent of any other factors, it will be appreciated that the pressure drop progressively increases as the distance between supply portion A and dispensing portion C increases. In accordance with the present invention, supplemental syrup supply portion B of the system is as close as possible to dispensing portion C and is operable, when necessary, to assure the dispensing of syrup through the dispensing valves at the dispensing stations at a predetermined constant pressure to consistently obtain the dispensing of a predetermined quantity of syrup across the syrup dispensing valves so as to consistently obtain a desired syrup to soda water ratio in dispensed drinks. In connection with the following description of the operation of the supplemental syrup supply system for this purpose, it will be assumed, for purposes of an example only, that the syrup delivery pressure generated at each of the syrup supply reservoirs 10 and 12 is 50 psi and that the predetermined constant syrup dispensing pressure to be maintained at the syrup dispensing valves is achieved with a syrup chamber pressure of 30 psi. It will be further assumed that the distance between supply portion A and dispensing portion C together with other factors affecting pressure drop is such that the delivery pressure is sufficient to provide the required dispensing pressure in response to the opening of just one of the two syrup dispensing valves for each of the syrups A and B.

Further assuming that the systems have been in operation whereby chambers 36 contain the corresponding syrup at the top level F bridging the corresponding top level detector probes 50 and that the systems B1 and B2 include the syrup flow control valve arrangement 40 shown in FIG. 2, operation of the systems is as follows. Assuming first that syrup dispensing valve 20 is opened at dispensing station D1, syrup A is delivered thereto through line 14 by the delivery pressure generated at reservoir 10. The flow of syrup through line 14 is detected by flow meter 64 which outputs a control signal through line 66 to controller 42 and in response to which controller 42 outputs a control signal through fine 80 to open normally closed $CO_2$ flow control valve 32. Opening of valve 32 pressurizes chambers 36 of both systems B1 and B2 to 30 psi. In response to activation by flow meter 64 controller 42 also outputs a control signal through line 82 to exhaust valve control component 70 for the purpose set forth hereinafter. Since there is no flow at this time in delivery line 16 from syrup reservoir 12, flow meter 64 in system B2 does not send any signal to controller 42 of the latter system, whereby there is no output through fine 80 to valve 32 or through line 82 to exhaust valve controller 70 from system B2. Moreover, as will be appreciated from FIG. 2 and the foregoing assumptions regarding the delivery pressure of syrup in lines 14 and 16, the pressure against the downstream side of both valve elements 72 maintains the latter closed, whereby the dispensing operation is accomplished by syrup flow directly from reservoir 10 to dispensing valve 20 at the dispensing station. When dispensing valve 20 closes indicating the end of the dispensing operation, flow ceases through delivery line 14 and flow meter 64 notifies controller 42 via line 66 of termination of the dispensing operation, whereupon the control signal through line 80 is removed to close $CO_2$ flow control valve 32 and the control signal through line 82 to exhaust valve control component 70 is removed whereupon the latter outputs a control signal through line 84 to momentarily open exhaust valve 68 whereupon chambers 36 of systems B1 and B2 are exhausted to atmosphere.

If syrup dispensing valve 24 for syrup B at station D1 is opened at the same time that dispensing valve 20 for syrup A is opened, it will be appreciated from the foregoing description that valve element 72 of valve arrangement 40 in system B2 will be maintained closed by the syrup delivery pressure in line 16 whereby dispensing through valve 24 is achieved by syrup flow directly from reservoir 12. However, controller 42 in system B2 is activated by flow meter 64 sensing syrup flow in line 16, whereby the latter outputs its control signal through line 80 to $CO_2$ flow control valve 32 and outputs a control signal through its line 82 to exhaust valve control component 70. If syrup dispensing valve 20 closes while syrup dispensing valve 24 remains open, the control signal to valve 32 through line 80 in system B1 is removed and the signal through line 82 in system B1 to exhaust valve controller 70 is removed. However, the signals through lines 80 and 82 from controller 42 in system B2 maintain valve 32 open and exhaust valve 68 closed until syrup dispensing valve 24 closes at the end of its dispensing operation. At that point, the signal through line 80 to valve 32 from controller 42 of system B2 is removed, whereby valve 32 closes, and the signal through line 82 in system B2 to exhaust valve control component 70 is removed, whereby the latter outputs a control signal through line 84 to momentarily open exhaust valve 68.

Assuming now that syrup dispensing valve 20 at dispensing station D1 has been activated whereby supplemental syrup supply systems B1 and B2 are pressurized as described above and syrup is dispensed across valve 20 from reservoir 10, and further assuming that syrup dispensing valve 22 at station D2 is activated during the dispensing operation through valve 20 whereby the pressure drop in syrup delivery line 14 falls below the 30 psi in syrup chambers 36 of both systems B1 and B2, the latter systems operate as follows. As will be appreciated from the foregoing description, the delivery pressure in syrup delivery line 16 of system B2 will maintain the corresponding valve arrangement 40 closed, and there is no flow through line 16 whereby controller 42 of system B2 is not activated and accordingly does not output signals through lines 80 and 82 to $CO_2$ flow control valve 32 and exhaust valve control component 70. As will be appreciated from FIG. 2 and the foregoing description of flow control valve arrangement 40 shown therein, the drop in pressure in line 14 below the 30 psi in chamber 36 in system B1 results in the leakage flow of syrup from chamber 36 across valve element 72 to line 14. This flow drops the level of syrup in the chamber below the lower ends of top level sensor probes 50, whereupon sensor 48 outputs a signal through line 52 to controller 42 in system B1 whereupon controller 42 outputs a control signal through line 86 to syrup flow control valve arrangement 40 to active solenoid 78 thereof and displace valve element 72 to its open position enabling full flow of syrup S from chamber 36 to line 14. Controller 42 then operates in response to the signal through line 62 from pressure transducer 60 to control $CO_2$ flow control valve 32 so as to maintain the predetermined constant 30 psi pressure in chamber 36 during simultioneous acuation of syrup dispensing valves 20 and 22. Assuming now that syrup dispensing valve 20 closes and that syrup dispensing valve 22 remains open, the delivery pressure in delivery line 14 is again sufficient to dispense the required quantity of syrup across valve 22. Syrup flow control valve arrangement 40 in system B1 remains open and syrup in delivery line 14, which is now at a pressure above the 30 psi pressure maintained in chamber 36 causes syrup to flow into the latter chamber to refill the chamber to the level F at the lower ends of probes 50. When syrup S reaches this level, which can be during completion of the dispensing across syrup dispensing valve 22 or after closure of the latter valve, controller 42 responds to a corresponding signal from top sensor 48 to output a signal through line 86 to close syrup flow control valve arrangement 40. When syrup dispensing valve 22 closes, whereby there is no syrup flow through delivery line 14 across flow meter 64 to the dispensing stations, the flow meter outputs a signal through line 66 to conroller 42 in response to which the controller output signals through lines 80 and 82 are removed. Thus, $CO_2$ flow control valve 32 closes and exhaust valve control component 70 outputs a signal through line 84 to momentarily open exhaust valve 68.

As will be appreciated from the foregoing description, the simultaneous opening of syrup dispensing valves 24 and 26 associated with syrup delivery line 16 will cause the same operation of supplemental syrup supply system B2 as described above which respect system B1. In the event that all 4 of the syrup dispensing valves 20, 22, 24, and 26 are simultaneously opened, each of the systems B1 and B2 will operate as described to maintain a constant pressure of 30 psi in the syrup chambers 36. In connection with this scenario, $CO_2$ flow control valve 32 will remain operative and exhaust valve 68 will remain closed until the last dispensing operation requiring operation of systems B1 and B2 is completed. In this respect, for example, if syrup dispensing valves 20 and 22 close while valves 24 and 26 remain open, system B1 operates as described above to refill the corresponding syrup chamber 36 and remove the control signals through lines and 80 and 82 to $CO_2$ flow control valve 32 and control component 70 of exhaust valve 68. The continued dispensing through syrup dispensing valves 24 and 26 associated with syrup delivery line 16 will maintain the control signals through lines 80 and 82 of system B2 to keep $CO_2$ flow control valve 32 operative and exhaust valve 68 closed. Further in connection with this scenario, the refilling of chamber 36 of system B1 with syrup would be against the 30 psi pressure maintained therein, whereby the latter is operable though line 58 in system B1 and manifold line 34 to assist in maintaining the 30 psi pressure in syrup chamber 36 of system B2. Still further, should valves 20 and 24 close while valves 22 and 26 remain open, both chambers 36 can be refilled simultaneously.

In connection with operation of both systems B1 and B2, there will come a time when the supply of syrup in syrup reservoirs 10 and 12 is depleted to the extent that the corresponding syrup chamber 36 will not refill to level F of top sensor probes 50. When this condition exists, controller 42 can output an appropriate warning signal to advise personnel in the establishment of the low syrup supply situation and, preferably, continued operation of the system is enabled until such time as the syrup level in chamber 36 falls to level L below the level of bottom level probes 54. Such continued operation provides personnel in the establishment with a time window for replacing the depleted syrup reservoir and, for example, precludes having to shut the system down during a period of high dispensing demand at the dispensing stations. At the same time, when the level of syrup falls to level L below bottom probes 54 it is desired to preclude further delivery of syrup S from the corresponding syrup chamber to prevent the delivery of $CO_2$ into the syrup delivery line and thus into dispensed drinks. In the supplemental syrup supply systems illustrated in FIG. 1 using the syrup control valve arrangement 40 shown in FIG. 2, such control of the delivery of syrup from the syrup chambers can be achieved as follows. If controller 42 does not receive a signal through line 52 from top fill sensor 48 within a predetermined period of time following a signal from flow meter 64 indicating completion of a dispensing operation and no flow of syrup through the corresponding delivery line, timing circuitry 44 of controller 42 can cause the latter to output a signal through line 86 for closing syrup flow control valve arrangement 40. Thereafter, subsequent dispensing operations will progressively deplete the supply of syrup in the corresponding chamber 36 and, ultimately, the syrup level will reach level L below probes 54 of the bottom level sensor. When the latter occurs, controller 42 receives a signal through line 56 and in response thereto outputs a signal through line 88 to close $CO_2$ shutoff valve 71 to the chamber. This precludes the flow of $CO_2$ into the chamber and thus the leakage of syrup across valve arrangement 40 and opening of the latter valve. Controller 42 can also output a signal at this time through line 90 to the corresponding syrup supply reservoir to deactivate the latter. When a new syrup supply has been connected to the corresponding delivery line, controller 42 can be activated to open syrup flow control valve arrangement 40 to refill the corresponding syrup chamber 36, whereby the corresponding supplemental syrup supply system is ready for operation. Upon refilling of the chamber, top sensor 48 outputs a signal through line 52 to controller 42 in response to which the latter outputs a signal through line 86 to close valve arrangement 40 and outputs a signal through line 88 to open $CO_2$ shutoff valve 71. Thus, it will be appreciated that either one of the systems B1 and B2 in which the syrup supply becomes depleted can be deactivated or isolated without having to deactivate the other.

In accordance with another aspect of the invention, it is desirable to assure delivery of syrup S from chambers 36 to the corresponding delivery line so as to preclude a residence time of the syrup in the chamber which could result in the syrup becoming stale. In this respect, since the supplemental syrup supply systems operate on an as-needed basis, there may be long periods between the operation thereof and during which the syrup could become stale and/or carbonated as a result of the repeated pressurization thereof in the chamber. Thus, in accordance with this aspect of the invention, syrup S is intentionally delivered from chambers 36 to the corresponding delivery line periodically, either on a predetermined time basis or on a basis of use over a period of time. In this respect, for example, controller 42 can be programmed to cause forced delivery of syrup from the corresponding chamber 36 at predetermined intervals of time determined by timing circuitry 44. At such time, controller 42 would output a signal through line 90 to deactive the corresponding syrup supply reservoir pump whereby subsequent dispensing operations of the syrup initiated at dispensing stations D1 and D2 would result in the delivery of syrup thereto from the corresponding syrup chamber until such time as the level of syrup in the chamber reaches level L below probes 54 of the bottom level sensor. At that time, the controller would respond to an output signal through line 56 from the bottom level sensor to output a signal through line 90 to reactivate the syrup supply pump and would output a signal through line 86 to open valve arrangement 40, whereupon syrup from the corresponding supply reservoir would flow through the corresponding delivery line and into the corresponding syrup chamber to refill the latter. Alternatively, controller 42 can, through top level sensor 48, record in its memory the number of times that syrup has been delivered from the corresponding chamber over a predetermined period of time and, if the number of times recorded is less than a predetermined number of times for the predetermined period of time, the controller can output a signal through line 90 to deactive the corresponding supply reservoir pump. Syrup is then displaced from the syrup chamber in response to subsequent dispensing operations at stations D1 and D2 in the same manner as described above and, likewise, the chamber is refilled and the corresponding syrup reservoir pump reactivated as described above when the syrup level reaches level L below probes 54. As an alternative to deactivating the syrup supply pump in connection with forced dispensing from the syrup chamber, an isolating valve can be provided in delivery lines 14 and 16 upstream of the chamber to isolate the chamber from the supply.

Figure 3:
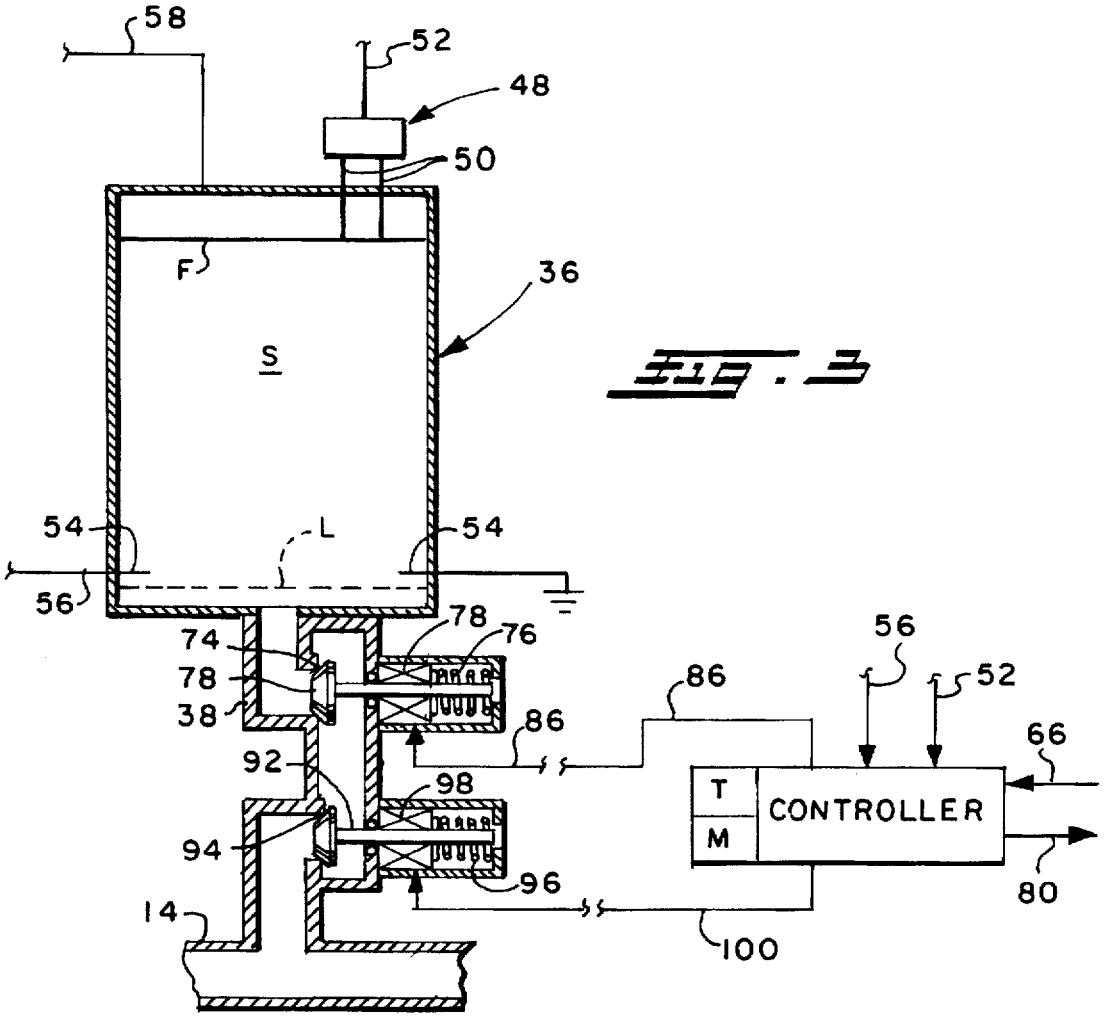
FIG. 3 is a schematic illustration of another embodiment of a syrup flow control valve arrangement for use with the system illustrated in FIG. 1.

FIG. 3 illustrates another emboidment of syrup fluid flow control valve arrangement 40 for use with the supplemental syrup supply systems shown in FIG. 1 and which is illustrated in FIG. 3 in connection with syrup delivery line 14 and thus supplemental supply system B1. Valve arrangement 40 illustrated in FIG. 3 includes solenoid-operated valve element 72 described hereinabove in connection with FIG. 2 and, additionally, includes a solenoid operated valve element 92 which is normally closed against its valve seat 94 by a biasing spring 96. Valve element 92 is adapted to be displaced to its open position by solenoid coil 98 against the bias of spring 96, and it will be noted that spring 96 biases valve element 92 in the direction of syrup flow thereacross from chamber 36 to delivery line 14. As will become apparent hereinafter, the inclusion of valve element 92 between chamber 36 and the syrup delivery line eliminates the need for shut-off valve 71 in $CO_2$ branch line 58 in connection with precluding the displacement of syrup from the chamber when the syrup is at the low level L below bottom sensor probes 54.

The following description of the operation of valve arrangement 40 shown in FIG. 3 will be readily understood from the foregoing description of FIGS. 1 and 2. When flow sensor 64 senses flow in delivery line 14 and outputs a signal through line 66 to controller 42 indicating such flow, controller 42 outputs a control signal through line 80 to open $CO_2$ flow control valve 32 whereby syrup chambers are pressurized through branch lines 58. At the same time, controller 42 outputs a control signal through line 100 by which solenoid 98 of second valve element 92 is activated to displace valve element 92 to its open position. If the 30 psi pressure in syrup chamber 36 is greater than the delivery pressure in line 14, syrup leaks across valve element 72 against the force of biasing spring 76 whereby the syrup level drops below the lower ends of probes 50. As with the embodiment using the valve arrangement shown in FIG. 2, top level probe 48 outputs a signal through line 52 to controller 42 indicating the drop in level whereupon controller 42 outputs a signal through line 84 for activating solenoid 78 of valve element 72 to open the latter for free flow of syrup from chamber 36 to line 14 at the constant pressure of 30 psi. When the flow in line 14 stops as a result of completing the dispensing operation, both valve element 72 and 92 can be maintained open during the refilling of chamber 36 and simultaneously closed when upper level F is reached or, alternatively, valve element 72 can remain open and valve element 92 can be closed in which case the refilling of chamber 36 takes place across the latter valve element against the bias of spring 96. As in the embodiment illustrated in FIGS. 1 and 2, should the delivery pressure in line 14 be greater than the 30 psi to which chamber 36 is pressurized when a dispensing operation is initiated and valve element 92 displaced to its open position, there will be no leakage of syrup across valve element 72 and thus no delivery of syrup from chamber 36 to line 14. Also as in the embodiment illustrated and described in connection with FIGS. 1 and 2, valve elements 72 and 92 can be controlled in the foregoing manner by controller 42 to enable the forced dispensing of syrup from chamber 36 or the continued dispensing of syrup therefrom as the syrup supply approaches depletion. In both such operations, when the syrup reaches low level L below probes 54 of the bottom sensor, a signal is outputed through line 56 to controller 42 in response to which the controller outputs signals through lines 84 and 100 for deactivating the corresponding solenoid coil and thus dosing valve elements 72 and 92. As long as the syrup is at low level L valves 72 and 92 remain closed. Accordingly, the $CO_2$ shutoff valve 71 described hereinabove in conjunction with FIG. 1 is not necessary in that valve element 92 precludes the flow of syrup from chamber 36 to line 14 as the result of any subsequent pressurization of chamber 36 through the operation of system B2.

Figure 4:
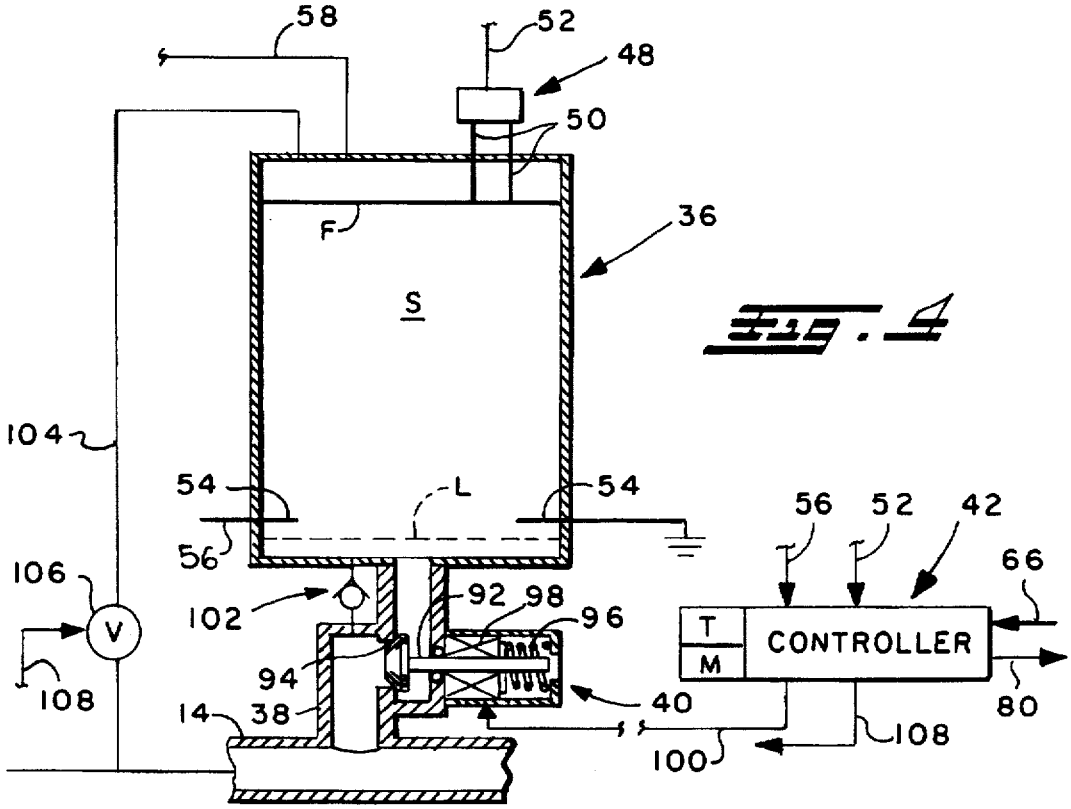
FIG. 4 is a schematic illustration of yet another embodiment of a syrup flow control valve arrangement for use in the system illustrated in FIG. 1.

FIG. 4 illustrates yet another embodiement of syrup flow control valve arrangement 40 for use with the supplemental syrup supply systems illustrated and described in connection with FIG. 1. In this embodiment, the valve arrangement is defined by the second valve element 92 in the embodiment illustrated and described with regard to FIG. 3 and which, as in the latter embodiment, is spring biased closed in the direction of flow of syrup thereacross from chamber 36 to line 14 and, thus, precludes the flow of syrup from chamber 36 when closed. In this embodiment, biasing spring 96 has a force sufficient to maintain valve element 92 closed against the leakage of syrup thereacross from line 14 under the delivery pressure therein. In connection with the operation of the supplemental syrup supply systems using this embodiment of syrup flow control valve arrangement 40, flow meter 64 is operable upon the initiation of a dispensing operation at dispensing stations D1 and D2 to output a control signal through line 66 to controller 42 which is indicative of flow and of the delivery pressure in line 14. Controller 42 as in the previous embodiments outputs a signal through line 80 to open $CO_2$ flow control valve 32 whereby both syrup chambers 36 are pressurized to provide the 30 psi pressure therein. Controller 42 compares the delivery line pressure signal through line 66 with the 30 psi pressure signal through line 62 from pressure transducer 60 and, if the delivery line pressure is higher than the chamber pressure, valve element 92 remains closed. If on the other hand the delivery pressure in line 14 is less than 30 psi, controller 42 outputs a signal through line 100 for activating solenoid coil 98 to open valve element 92 whereupon syrup is delivered from chamber 36 to delivery line 14, and the controller operates as before to constantly maintain the 30 psi pressure in chamber 36 during the delivery of syrup therefrom. When the dispensing operation is completed, controller 42 maintains valve element 92 open for chamber 36 to be refilled from the supply reservoir through delivery line 14 as in the previous embodiments. As will be appreciated from the description of the previous embodiments and the description of valve element 92 in connection with FIG. 3, the syrup flow control valve arrangement shown in FIG. 4 is operable through controller 42 to enable the forced dispensing of syrup from chamber 36 or the continued dispensing of syrup therefrom as the syrup supply becomes depleted. Further in this respect, when the syrup in chamber 36 reaches low level L controller 42 is responsive to a signal through line 56 indicating this condition to output a signal through line 100 for deactivating solenoid 98 and thus closing valve element 92 until such time as the chamber is refilled. Further, as with the embodiment of FIG. 3, the orientation of valve element 92 precludes the flow of syrup from chamber 36 to delivery line 14 and thus elminates the need for $CO_2$ shutoff valve 71 in branch line 58 to the chamber.

As an alternative to controlling the operation of valve element 92 in FIG. 4 on the basis of comparing the delivery pressure in line 14 and the constant pressure applied to the syrup chamber, a check valve 102 could be provided in flow communication with chamber 36 and delivery line 14 to enable operation of the system in connection with the delivery of syrup from chamber 36 to line 14 on the basis of leakage from chamber 36 when the 30 psi pressure therein is greater than the delivery pressure in line 14. In this respect, valve 102 would be spring biased closed to preclude syrup flow thereacross from delivery line 14 to chamber 36, and the spring bias would have a force which would provide for leakage of syrup thereacross from chamber 36 to delivery line 14 only when the delivery line pressure is below the 30 psi maintained in the syrup chamber. Such leakage, as with the embodiment of the valve arrangement illustrated in FIG. 2, would lower the syrup level in chamber S from upper level F and controller 42 would be operable in response to the latter condition to output a signal through line 100 to cause opening of valve element 92 and thus full flow of syrup from chamber 36 to delivery line 14.

While it is preferred to refill chambers 36 through the bottom opening therein and across the syrup flow control valve arrangement in line 38 in that this arrangement lends to structural simplicity and fewer component parts, it is possible to refill the chambers through an opening in the top thereof and such a modification, which is applicable to the previously described embodiments, is illustrated in FIG. 4. More particularly in this respect, a chamber refill line 104 is connected in flow communication with syrup delivery line 14 and the top of the chamber 36, and a normally closed solenoid operated flow control valve 106 is interposed in line 104 for controlling the flow of syrup from delivery line 14 to chamber 36. With such a refill arrangement, syrup flow control valve arrangement 40 would be closed by conroller 42 at the end of a dispensing operation, and the controller would output a signal through line 108 to valve 106 to open the latter, whereupon syrup from the supply reservoir would be delivered through line 104 to refill chamber 36. When the chamber is refilled to level F the output signal through line 52 from top level sensor 48 to controller 42 would cause the latter to output a signal through line 108 to close valve 106.

It is preferred as set forth herein to control initiation of the operation of the supplemental syrup supply systems through the use of a flow meter or the like in the syrup delivery lines in that such advantageously eliminates the need for syrup delivery system controls at the dispensing stations. At the same time, however, it will be appreciated that the syrup dispensing valves at the dispensing stations could be provided with signal lines to the controller of the associated supplemental supply system for initiating the pressurizing operation and for indicating the termination of a dispensing operation through the dispensing valve.

Figure 5:
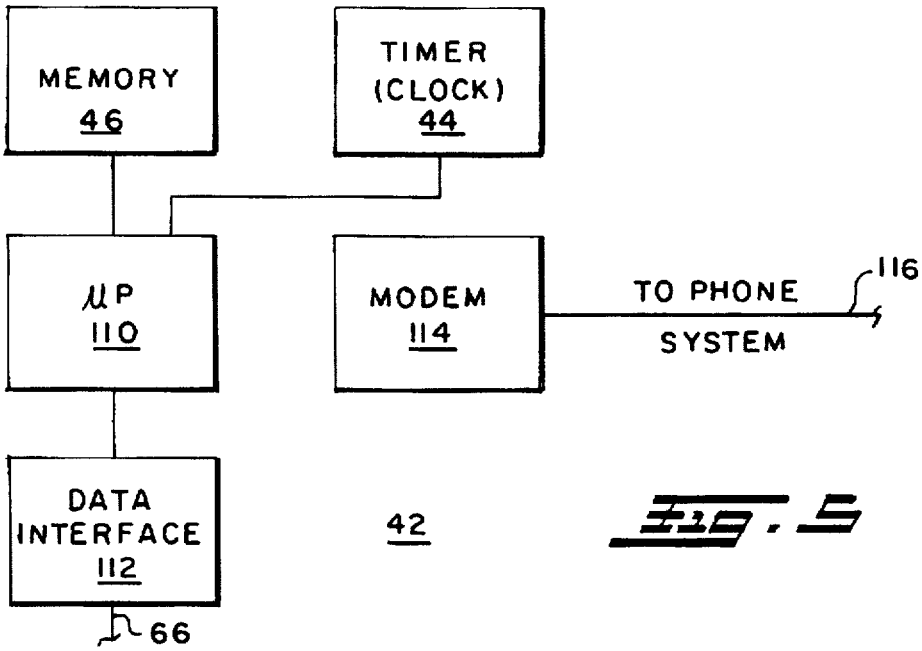
FIG. 5 is a block diagram of a portion of the system control by which statistical information regarding syrup inventory is gathered and made accessible.

In accordance with another aspect of the invention, as illustrated in FIG. 5 of the drawings, each of the controllers 42 can be designed to provide syrup-monitoring functions which regard to the corresponding syrup supply reservoir and as provided by information from the corresponding flow meter 64. More particularly, in this respect, controller 42 includes a microprocessor 110, a data interface 112, and modem 114. Data interface 112 is shown as receiving syrup consumption information through line 66 from flow meter 64 and which in connection with well known flow meter operation, can be the quantity of syrup delivered through delivery line 14 and thus the quantity delivered from the corresponding syrup supply reservoir. Data interface 112 conditions this information into acceptable signals for microprocessor 110. Timer 44, in addition to its functions previously described herein, is a clock which provides date and time information for storage in memory 46. Modem 114 is connected to microprocessor 110 and to a telephone system through line 116 in a well known manner. Modem 114 enables the microprocessor to initiate a telephone call to a telephone number outside the establishment in which the system exists, and enables a third party to call the controller through the telephone number to which the moden is connected. Thus, the microprocessor can initiate a telephone call or calls to, for example, a syrup supplier for the establishment. Such a call can be initiated at predetermined periods of time to provide information regarding the status of the syrup supply at the establishment, or can be initiated anytime a malfunction of the system occurs or a low syrup supply condition exists. The call-in capability enables a third party, through a digital signaling device, to transmit inquiries over the phone system through the modem to the microprocessor to obtain current information regarding, for example, the mount of syrup dispensed over a given interval of time, as well as any other information regarding the system which is designed to be stored in the memory of the controller for such access. Controller 42 associated with each of the syrups A and B can have its own telephone number or can be part of a group of controllers associated with various syrup flavors assigned to the same telephone number. Thus, each modem can be individually addressed over the same line. These features advantageously allow an establishment and/or a chain of establishments and/or a syrup provider or providers as well as other authorized third parties, to obtain and maintain information on syrup consumption. This information, for example, enables tracking not only the syrup consumption, but also consumer responses to advertising campaigns, changes in consumer tastes nationally and in different geographical areas, and provides basic marketing statistics useful in planning advertising campaigns and forecasting future consumption of different syrup flavors and/or brands.

While considerable emphasis has been placed on the embodiements herein illustrated and described, it will be appreciated that other embodiements of the invention can be made and that many changes can be made in the disclosed embodiements without departing from the principles of the invention. In particular in this respect, while supplemental syrup supply systems B1 and B2 have been described hereinabove as having corresponding controllers 42, it will be appreciated from the description and will be obvious to those skilled in the art that such multiple systems can be controlled by a single common controller. Further in this respect, for example, it will be appreciated that the constant pressure delivery of syrup to the dispensing valves would enable the use of fixed orifices therein instead of the pressure responsive flow control valves. Further, each of the supplemental syrup supply systems can be connected to its own source of $CO_2$ under pressure as opposed to being connected to a common source, and each system can be associated with just one dispensing station or more than two dispensing stations. Further in this respect, each dispensing station can include two or more dispensing units for the same syrup. Similarly, the syrup supply can be provided by multiple reservoirs for each syrup. Still further, the dispensing portion of the beverage dispensing system can include a chiller or other arrangement for cooling the syrup and soda water delivered thereto. These and other modifications will be obvious or suggested to those skilled in the art from the disclosure herein. Accordingly, it is to be distinctly understood that the foregoing descriptive manner is to be interpreted mearly as illustrative of the invention and not as a limitation.

Having thus described the invention, it is claimed:

1. A supplemental syrup supply system for a beverage dispenser comprising syrup reservoir means, syrup dispensing means having a dispensing mode, and delivery line means between said reservoir means and said dispensing means, said reservoir means including means for delivering syrup through said line means to said dispensing means at a first pressure when said dispensing means is in said dispensing mode, said supplemental supply system comprising a syrup chamber between said reservoir means and said dispensing means, means including syrup flow control valve means connecting said chamber in flow communication with said line means for controlling the flow of syrup from said chamber to said dispensing means, a source of gas under pressure, dispensing sensing means for sensing said dispensing means in said dispensing mode, means including control means responsive to said sensing means for connecting said source of gas with said chamber for pressurizing syrup in said chamber to a second pressure, and means including said control means for controlling said syrup flow control valve means for delivering syrup from said chamber to said dispensing means when said second pressure is greater than said first pressure.

2. A system according to claim 1, wherein said dispensing sensing means includes flow sensing means in said line means.

3. A system according to claim 1, wherein said syrup flow control valve means includes solenoid operated valve element means having open and closed positions, upper level sensing means for sensing a predetermined upper level of syrup in said chamber, and means including said control means responsive to said upper level sensing means for displacing said valve element means to said closed position when said syrup is at said upper level and to said open position when said syrup is below said upper level.

4. A system according to claim 3, wherein said valve element means is spring biased in said closed position, said spring bias being in the direction opposite the direction of flow of syrup across said valve element means from said chamber to said line means, whereby said valve element means is displaced from said closed position toward said open position against said spring bias when said second pressure is greater than said first pressure.

5. A system according to claim 1, wherein said syrup flow control valve means includes solenoid operated valve element means having open and closed positions, and means including said control means for displacing said valve element means to said closed position when said second pressure is below said first pressure and to said open position when said second pressure is greater than said first pressure.

6. A system according to claim 5, wherein said valve element means is spring biased in said closed position, said spring bias being in the direction of flow of syrup across said valve element means from said chamber to said line means.

7. A system according to claim 1, further including low level sensing means for sensing a syrup level in said chamber below a predetermined low level, and means including said control means responsive to said low level sensing means for precluding the delivery of syrup from said chamber to said line means.

8. A system according to claim 7, wherein said means for connecting said source of gas with said chamber includes gas flow control valve means having open and closed positions, and said means for precluding the delivery of syrup from said chamber includes means responsive to said low level sensing means for closing said gas flow control valve means.

9. A system according to claim 7, wherein said syrup flow control valve means includes first and second spring biased valve element means each having an open position and a closed position and spring means biasing the corresponding valve element means to the closed position thereof, said spring means of said first valve element means biasing said first valve element means in the direction opposite the direction of flow of syrup thereacross from said chamber to said line means, and said spring means of said second valve element means biasing said second valve element means in the direction of flow of syrup thereacross from said chamber to said line means.

10. A system according to claim 9, wherein each said first and second value element means is solenoid operated from the closed to the open position thereof.

11. A system according to claim 1, wherein said syrup flow control valve means has open and closed positions, means for sensing said first pressure, means for sensing said second pressure, and means including said control means for opening said syrup flow control valve means when said second pressure is greater than said first pressure.

12. A system according to claim 1 and means including said control means for monitoring the consumption of syrup from said supply means in response to said dispensing means being in said dispensing mode.

13. A system according to claim 12, wherein said control means includes a microprocessor having timer means and a memory for storing information corresponding to the quantity of syrup dispensed from said supply means, and means for accessing said information.

14. A system according to claim 13, wherein said means for accessing includes a modem for accessing said information through a telephone system.

15. A supplemental syrup supply system for a beverage dispenser comprising syrup reservoir means, syrup dispensing means having a dispensing mode, and delivery line means between said reservoir means and said dispensing means, said reservoir means including means for delivering syrup through said line means to said dispensing means at a first pressure when said dispensing means is in said dispensing mode, said supplemental supply system comprising a syrup chamber between said reservoir means and said dispensing means and having a bottom end, means including syrup flow control valve means connecting said chamber in flow communication with said line means for controlling the flow of syrup into said chamber from said supply means and from said chamber to said dispensing means, said syrup flow control valve means including solenoid operated valve element means having open and closed positions and spring means biasing said valve element means toward said closed position, a source of gas under pressure, flow sensing means in said line means for sensing said dispensing means in said dispensing mode, means including control means responsive to said sensing means for connecting said source of gas with said chamber for pressurizing syrup in said chamber to a second pressure, said spring means biasing said valve element means in the direction opposite the direction of flow of syrup thereacross from said chamber to said line means, whereby said valve element means is displaced from said closed position toward said open position for flow thereacross from said chamber to said line means when said second pressure is greater than said first pressure, and means including said control means responsive to said flow across said valve element means to activate said solenoid operated valve element means to said open position.

16. A system according to claim 15, wherein said means responsive to flow across said valve element means includes upper level sensing means for sensing a predetermined upper level of syrup in said chamber, and means including said control means responsive to said upper level sensing means for actuating said valve element means to said open position when said syrup level is below said upper level.

17. A system according to claim 16, further including low level sensing means for sensing a syrup level in said chamber below a predetermined low level, and means including said control means responsive to said low level sensing means for precluding the delivery of syrup from said chamber to said line means.

18. A system according to claim 17, wherein said means for precluding the delivery of syrup from said chamber to said line means includes means responsive to said low level sensing means for disconnecting said chamber from said source of gas.

19. A system according to claim 17, wherein said solenoid-operated valve element means is first valve element means and said spring means is first spring means, said syrup flow control valve means including second solenoid-operated valve element means having open and closed positions and second spring means biasing said second valve element means toward the closed position thereof, said second spring means biasing said second valve element means in the direction of flow of syrup thereacross from said chamber to said line means, and means responsive to said low level sensing means for activating said second valve element means to said closed position thereof.

20. A system according to claim 15, wherein said second pressure has a predetermined magnitude, pressure sensing means for sensing said second pressure in said chamber, and means including said control means for activating said solenoid operated valve element means to said open position when said second pressure is below said predetermined pressure.

21. A system according to claim 20, further including low level sensing means for sensing a syrup level in said chamber below a predetermined low level, and means including said control means responsive to said low level sensing means for precluding the delivery of syrup from said chamber to said line means.

22. A system according to claim 21, wherein said means for precluding the delivery of syrup from said chamber to said line means includes means responsive to said low level sensing means for disconnecting said chamber from said source of gas.

23. A system according to claim 21, wherein said solenoid-operated valve element means is first valve element means and said spring means is first spring means, said syrup flow control valve means including second solenoid-operated valve element means having open and closed positions and second spring means biasing said second valve element means toward the closed position thereof, said second spring means biasing said second valve element means in the direction of flow of syrup thereacross from said chamber to said line means, and means responsive to said low level sensing means for activating said second valve element means to said closed position thereof.

24. A method of dispensing a beverage syrup from a source of syrup to syrup dispensing means comprising, providing a syrup chamber between said source and said dispensing means, delivering a quantity of syrup to said chamber from said source, actuating said dispensing means to dispense syrup therefrom, delivering syrup from said source to said dispensing means at a first pressure in response to said actuating, pressurizing said syrup in said chamber to a second pressure, and supplementing the delivery of syrup from said source to said dispensing means by delivering syrup from said chamber to said dispensing means when said first pressure is less than said second pressure, and maintaining said second pressure in said chamber during the dispensing of syrup from said dispensing means.

25. The method according to claim 24, wherein said pressurizing said syrup in said chamber is in response to said actuating, and venting said chamber to atmosphere following the dispensing of syrup from said dispensing means.

26. The method according to claim 25, wherein said venting is momentary, and then closing said chamber to atmosphere.

27. The method according to claim 24, including the further steps of sensing said delivery of syrup from said source to said dispensing means and pressurizing said chamber to said second pressure in response to said sensing.

28. The method according to claim 24, including the further steps of sensing a condition in said chamber indicative of said first pressure being less than said second pressure, and delivering syrup from said chamber to said dispensing means in response to sensing said condition.

29. The method according to claim 28, wherein said condition is a drop in the level of syrup in said chamber from a level corresponding to said quantity delivered thereto from said source.

30. The method according to claim 28, wherein said condition is a drop in pressure in said chamber from said second pressure.

31. The method according to claim 24, including the further step of delivering syrup to said chamber from said source following the dispensing of syrup from said dispensing means to replace syrup delivered from said chamber during said dispensing.

32. The method according to claim 31, wherein said pressurizing said syrup in said chamber is in response to said actuating, and venting said chamber to atmosphere following the dispensing of syrup from said dispensing means.

33. The method according to claim 24, including the further steps of sensing a low level of syrup in said chamber, and preventing delivery of syrup in said chamber to said dispensing means in response to sensing said low level.

34. The method according to claim 33, wherein the delivery of syrup in said chamber to said dispensing means is prevented by precluding said pressurizing of syrup in said chamber to said second pressure.

35. The method according to claim 24, including the further steps of sensing said delivery of syrup from said source to said dispensing means, pressurizing said chamber to said second pressure in response to said sensing said delivery, sensing a condition in said chamber indicative of said first pressure being less than said second pressure, delivering syrup from said chamber to said dispensing means in response to sensing said condition, delivering syrup to said chamber from said source following the dispensing of syrup from said dispensing means to replace syrup delivered from said chamber during said dispensing, and venting said chamber to atmosphere following said dispensing.

36. The method according to claim 35, wherein said venting is momentary, and then closing said chamber to atmosphere.

37. The method according to claim 35, including the further steps of sensing a low level of syrup in said chamber, and preventing delivery of syrup in said chamber to said dispensing means in response to sensing said low level.

38. The method according to claim 35, including the further steps of monitoring the consumption of syrup from said source, accumulating information corresponding to the quantity of syrup dispensed from said source, and providing means for accessing said information.

39. The method according to claim 24, including the further steps of monitoring the consumption of syrup from said source, accumulating information corresponding to the quantity of syrup dispensed from said source, and providing means for accessing said information.

40. A syrup dispensing system for a beverage dispenser comprising syrup supply means, syrup dispensing means having a dispensing mode, delivery line means between said supply means and said dispensing means, said supply means including means for delivering syrup through said line means to said dispensing means at a first pressure when said dispensing means is in said dispensing mode, a syrup chamber between said supply means and said dispensing means, means for delivering syrup to said chamber from said supply means, means for pressurizing syrup in said chamber to a second pressure, and means for delivering syrup at said second pressure from said chamber to said dispensing means when said first pressure is less than said second pressure.

41. A system according to claim 40, wherein said means for pressurizing syrup in said chamber includes means to maintain said second pressure in said chamber during said delivery of syrup from said chamber to said dispensing means.

42. A system according to claim 40, wherein said means for delivering syrup from said chamber to said dispensing means includes condition sensing means for sensing a condition in said chamber indicative of said first pressure being less than said second pressure.

43. A system according to claim 42, wherein said condition sensing means includes means for sensing a syrup level in said chamber.

44. A system according to claim 42, wherein said condition sensing means includes means for sensing a pressure in said chamber.

45. A system according to claim 40, wherein said means for delivering syrup from said chamber to said dispensing means includes valve means including pressure responsive valve means for delivering syrup from said chamber to said line means.

46. A system according to claim 45, wherein said valve means further includes solenoid operated valve means for delivering syrup from said chamber to said line means.

47. A system according to claim 46, wherein said solenoid operated valve means includes solenoid operated valve element means having open and closed positions and spring means biasing said valve element means toward said closed position, said spring biasing said valve element in the direction opposite the direction of flow of syrup across said valve element means from said chamber to said line means, whereby said valve element means provides said pressure responsive valve means.

48. A system according to claim 40, further including low level sensing means for sensing a low syrup level in said chamber, and means responsive to said low level sensing means for precluding said delivery of syrup from said chamber to said dispensing means.

49. A system according to claim 48, wherein said means responsive to said low level sensing means includes means to prevent said pressurizing of said chamber.

50. A system according to claim 48, wherein said means responsive to said low level sensing means includes valve means between said chamber and said line means.

51. The method according to claim 24, wherein said pressurizing said syrup in said chamber is in response to said activating, and discontinuing said pressurizing following the dispensing of syrup from said dispensing means.

52. The method according to claim 51, and venting said chamber to atmosphere following said discontinuing said pressurizing.

53. The method according to claim 52, wherein said venting is momentary, and then closing said chamber to atmosphere.

54. A method of dispensing a beverage syrup from first and second sources of syrup respectively to first and second syrup dispensing means comprising, providing first and second syrup chambers respectively between said first source and first dispersing means and between said second source and second dispensing means, delivering a quantity of syrup to said first and second chambers respectively from said first and second sources, actuating said first dispensing means to dispense syrup therefrom, delivering syrup from said first source to said first dispensing means at a first delivery pressure in response to said actuating, pressurizing said syrup in each said first and second chambers to a predetermined pressure in response to said actuating, supplementing the delivery of syrup from said first source to said first dispensing means by delivering syrup from said first chamber to said first dispensing means when said first delivery pressure is less than said predetermined pressure, and maintaining said predetermined pressure in each said first and second chambers during the dispensing of syrup from said first dispensing means.

55. The method according to claim 54, including the further steps of terminating said dispensing from said first dispensing means, discontinuing said pressurizing said syrup in each said first and second chambers following said terminating said dispensing of syrup from said first dispensing means, and then venting said first and second chambers to atmosphere.

56. The method according to claim 55, wherein said venting is momentary, and then closing said first and second chambers to atmosphere.

57. The method according to claim 54, including the further steps of actuating said second dispensing means to dispense syrup therefrom during said actuating of said first dispensing means, delivering syrup from said second source to said second dispensing means at a second delivery pressure in response to said actuating said second dispensing means, supplementing the delivery of syrup from said second source to said second dispensing means by delivering syrup from said second chamber to said second dispensing means when said second delivery pressure is less than said predetermined pressure, and maintaining said predetermined pressure in each said first and second chambers during the dispensing of syrup from said second dispensing means.

58. The method according to claim 57, including the further steps of terminating said dispensing of syrup from said first and second dispensing means, discontinuing said pressurizing said syrup in each said first and second chambers following said terminating said dispensing of syrup from said first and second dispensing means, and then venting said first and second chambers to atmosphere.

59. The method according to claim 58, wherein said venting is momentary, and then closing said first and second chambers to atmosphere.

60. The method according to claim 57, including the further steps of sensing said delivery of syrup from said first and second chambers, terminating said dispensing of syrup from at least one of said first and second dispensing means, and delivering syrup from the source corresponding to the one dispensing means to the chamber corresponding to the one dispensing means to replace syrup delivered from the latter chamber to said one dispensing means.

61. The method according to claim 60, wherein said latter chamber and the chamber corresponding to the other of said first and second dispensing means are connected in pressurizing communication with one another, and maintaining said predetermined pressure in said first and second chambers during the delivery of syrup to replace syrup delivered from said latter chamber.

62. The method according to claim 60, including the further steps of terminating said dispensing of syrup from the other of said first and second dispensing means, and delivering syrup from the source corresponding to the other dispensing means to the chamber corresponding to the other dispensing means to replace syrup delivered from the chamber corresponding to the other dispensing means to said other dispensing means.

63. The method according to claim 62, wherein said delivering syrup from the source corresponding to the one dispensing means to the chamber corresponding to the one dispensing means is simultaneous with said delivering syrup from the source corresponding to the other dispensing means to the chamber corresponding to the other dispensing means.

64. A method of delivering a beverage syrup from a source of syrup to dispensing means comprising, delivering syrup from said source directly to said dispensing means at a delivery pressure, providing a supplemental supply of said syrup, pressurizing said supplemental supply of syrup to a predetermined pressure, and delivering syrup from said supplemental supply to said dispensing means at said predetermined pressure when said delivery pressure is less than said predetermined pressure.

65. A method of simultaneously delivering a plurality of beverage syrups each from a corresponding source of syrup to corresponding dispensing means comprising, delivering syrup from each said source directly to the corresponding dispensing means at a corresponding delivery pressure, providing a supplemental supply of each of said syrups, pressurizing each said supplemental supply to a common predetermined pressure, and delivering syrup from each said supplemental supply to the corresponding dispensing means at said predetermined pressure when the corresponding delivery pressure is less than said predetermined pressure.

66. The method according to claim 65, wherein each said supplemental supply comprises a predetermined quantity of syrup, and delivering syrup from each source to the corresponding supplemental supply to provide said predetermine quantity after said delivering syrup from each said supplemental supply to the corresponding dispensing means.

67. The method according to claim 66, wherein said delivering syrup from each said source to the corresponding supplemental supply is simultaneous.

* * * * *